US005275025A

United States Patent [19]

Nakamura et al.

[11] Patent Number: 5,275,025

[45] Date of Patent: Jan. 4, 1994

[54] CLOTH AMOUNT DETECTOR IN WASHING MACHINE

[75] Inventors: Takeru Nakamura, Toyonaka; Mitsuyuki Kiuchi, Nara; Sadayuki Tamae, Toyonaka, all of Japan

[73] Assignee: Matsushita Electric Industrial Co., Ltd., Osaka, Japan

[21] Appl. No.: 925,277

[22] Filed: Aug. 6, 1992

[30] Foreign Application Priority Data

Sep. 8, 1991 [JP] Japan ..... 3-200592

[51] Int. Cl.[5] ..... D06F 33/02

[52] U.S. Cl. ..... 68/12.04; 68/12.05

[58] Field of Search ..... 68/12.01, 12.02, 12.04, 68/12.05

[56] References Cited

U.S. PATENT DOCUMENTS 4,779,430 10/1988 Thuruta et al. .

5,144,819 9/1992 Hiyama et al. ..... 68/12.05 X

FOREIGN PATENT DOCUMENTS 0252817 1/1988 European Pat. Off. .

1-119290 11/1985 Japan .

2008286 5/1979 United Kingdom .

*Primary Examiner*—Philip R. Coe

*Attorney, Agent, or Firm*—Wenderoth, Lind & Ponack

[57] ABSTRACT

A cloth amount detecting device in a washing machine including a process controller for controlling a process of washing, rinsing and spin-drying cloths put into the washing machine is designed to detect the amount of the cloths. If the user of the washing machine changes the level of water within the washing machine to a different water level after the amount of cloths has been detected, a reference value used to determine the amount of cloths is updated by learning in dependence on the water level so changed by the user and the number of waveforms of a drive motor, to thereby accomplish a determination faithful to the amount of cloths.

9 Claims, 3 Drawing Sheets

CLOTH AMOUNT DETECTOR IN WASHING MACHINE

BACKGROUND OF THE INVENTION

1. Field of the Invention

The present invention generally relates to an automated washing machine and, more particularly, to a cloth amount detecting device for use in the automated washing machine for detecting the amount of cloths put into the washing machine for washing.

2. Description of the Prior Art

In recent years the use of automated washing machines has gained wide acceptance, and the most sophisticated washing machine makes use of a cloth amount detecting device to permit the washing machine to provide an optimum water current and a process control scheme that are appropriate to the amount of cloths put into a washtub or basket and detected thereby. An example of the use of the cloth amount detecting device in the washing machine is disclosed in, for example, the Japanese Laid-open Patent Publication No. 1-119290, published May 11, 1989.

According to this publication, the cloth amount detecting device in the automated washing machine comprising a drive motor for driving a current inducing element such as, for example, a pulsator or an agitator includes an electromotive force detecting means. Specifically, the drive motor is switched on for a predetermined length of time after water has been filled in the washtub to a predetermined level, and is subsequently switched off. The electromotive force detecting means detects an electromotive force generated by the drive motor during an OFF period in which the drive motor is switched off subsequent to the ON period, that is, the predetermined length of time during which it has been switched on. The cloth amount detecting device also includes a determining means for determining the amount of cloths, put into the washtub for washing, in dependence on an output from the electromotive force detecting means.

It has, however, been found that the prior art cloth amount detecting device of the type referred to above has a problem which will now be discussed. In the system of the prior art cloth amount detecting device, since a reference cloth value utilized to compare with the actual amount of cloths to be washed is fixed to a predetermined cloth value, it often occurs that the reference cloth value does not match with the amount of cloths which the user of the washing machine has believed it ought to be, or with the amount of the cloths determined by the determining means due to a change in tension or an aging of a drive belt which is used to transmit a drive from the drive motor to the current inducing element.

SUMMARY OF THE INVENTION

The present invention has been devised with a view to substantially eliminating the above discussed problems inherent in the prior art cloth amount detecting device in the automated washing machine and is intended to provide an improved cloth amount detecting device wherein the reference value used in determining the amount of cloths to be washed varies generally in consistence with the use's sensation as to the amount of cloths he or she has put into the washtub.

To this end, the cloth amount detecting device in the automated washing machine according to the present invention includes a process control means for controlling a washing process executed by the washing machine, a drive motor installed for driving a current inducing element installed inside a washtub, a drive detecting means for detecting the number of revolutions of the drive motor, a water level setting means for setting a level of water inside the washtub, and a determining means operable in response to an output from the drive detecting means for determining the amount of cloths put into the washtub, said determining means having a reference value for the determination of the amount of the cloths which is variable with a setting data of the water level setting means.

According to the present invention, the reference value for the determination of the amount of the cloths to be washed undergoes a learning on the basis of the water level data furnished by the water level setting means and is therefore modified so as to be generally consistent with the user's sensation. Thus, any possibility that the reference value does not match with the amount of the cloths actually determined can advantageously be eliminated.

As discussed above, the cloth amount detecting device in the automated washing machine according to the present invention includes a process control means for controlling a washing process performed by the washing machine, a drive motor installed for driving a current inducing element installed inside a washtub, a drive detecting means for detecting the number of revolutions of the drive motor, a water level setting means for setting a level of water inside the washtub, and a determining means operable in response to an output from the drive detecting means for determining the amount of cloths put into the washtub.

The determining means undergoes a learning repeatedly in reference to a cloth data provided by the water level setting means thereby to update the reference value to be used for the determination of the amount of the cloths. Therefore, the cloth amount detecting device can be realized in which there is neither the possibility that the reference value for the determination of the amount of the cloths may depart from the user's sensation as to the amount of the cloths, nor the possibility that the reference value may not match with the amount of the cloths determined by the determining means due to a change in tension or an aging of the drive belt used to transmit the drive from the drive motor to the current inducing element.

BRIEF DESCRIPTION OF THE DRAWINGS

This and other objects and features of the present invention will become clear from the following description taken in conjunction with a preferred embodiment thereof with reference to the accompanying drawings, in which like parts are designated by like reference numerals and in which.

DETAILED DESCRIPTION OF THE PREFERRED EMBODIMENT

Figure 1:
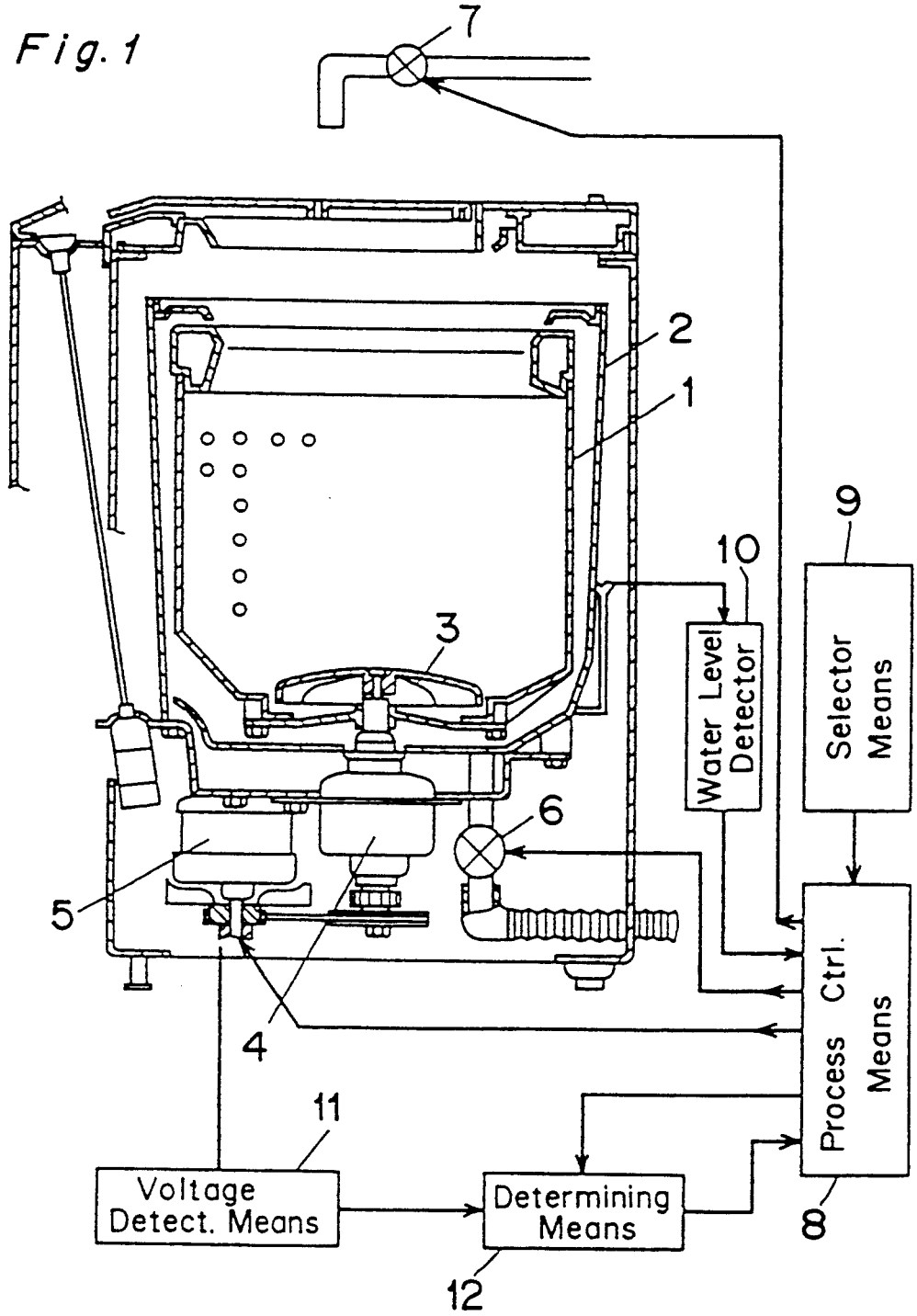
FIG. 1 is a schematic side sectional view of an automated washing machine incorporating a cloth amount detecting device according to the present invention.

An automated washing machine shown in FIG. 1 for the purpose of illustrating the present invention is a combined washer and spin-dryer of top loading model. The automated washing machine includes a hold 2 opening upwardly and closed at its bottom, a generally cylindrical perforated washtub 1 accommodated within the hold 2 in a coaxial relationship therewith. A current inducing element, for example, a disc-shaped pulsator 3 is installed at the bottom of the washtub 1 and is drivingly coupled with a drive motor 5 through a speed reduction unit 4 installed exteriorly beneath the bottom of the hold 1. The bottom of the hold 1 is fluid-connected to the outside of the washing machine through an electromagnetically controlled drain valve 6, whereas an electromagnetically controlled supply valve 7 is installed on a water supply line extending above the washtub 1. In any event, the washing machine of a construction so far described is well known and, therefore, the details thereof will not be herein discussed.

An electric control system employed in the washing machine includes a process control means 8, a selector means 9, a water level detecting means 10, a voltage detecting means 11 and a cloth determining means 12. The process control means 8 receives outputs generated from the selector means 9 and the water level detecting means 10 and sequentially controls the drive motor 5, the drain valve 6 and the supply valve 7 so that a process of washing, rinsing and spin-drying can be executed in a predetermined sequence. The voltage detecting means 11 is electrically connected with the drive motor 5 to detect a motor voltage which is one of physical parameters correlated with the number of revolutions of the drive motor 5. This voltage detecting means 11 feeds its output to the determining means 12 so that the latter can count the number of voltage waveforms generated by the voltage detecting means 11 and then compare the count value with a reference value.

Figure 2:
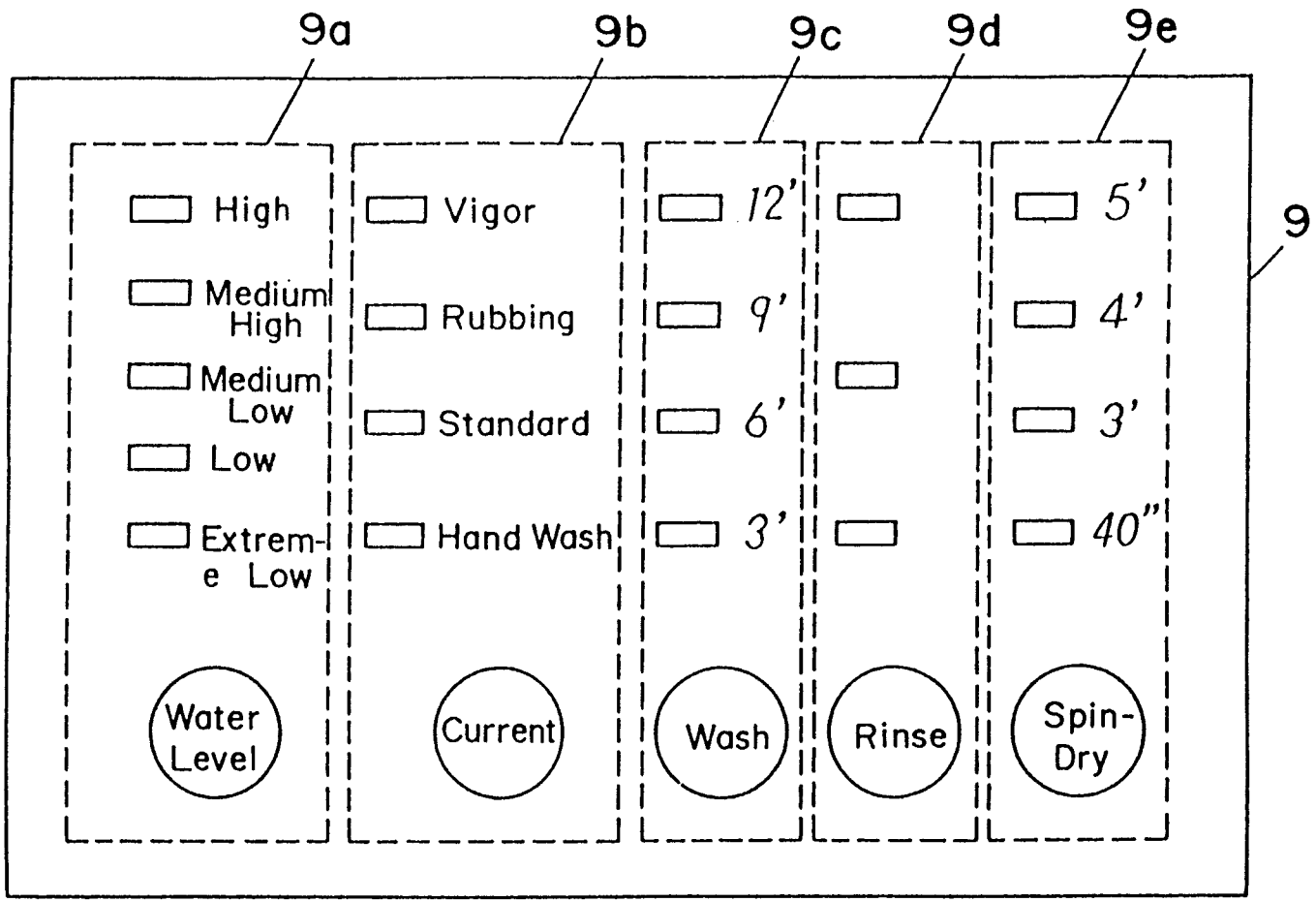
FIG. 2 is a schematic plan view of a selector means used in the cloth amount detecting device.

FIG. 2 illustrates the selector means 9 which includes a water level setting means 9*a*, a water current setting means 9*b*, a washing setting means 9*c*, a rinsing setting means 9*d* and a spin-drying setting means 9*e*.

The cloth amount detecting device of the above described construction operates in the following manner. When the washing machine is run after contents of the process have been selected and set by means of the selector means 9, the process control means 8 receives from the water level detecting means 10 information concerning the level of water within the washtub and causes the supply valve 7 to open so that water can be supplied into the hold 2 to a predetermined level. Then, the process control means 8 energizes the drive motor 5 to drive the pulsator 3. The supply of an electric power to the drive motor 5 is interrupted after a predetermined length of time subsequent to the start of rotation of the drive motor 5, causing the voltage detecting means 11 to supply to the determining means 12 a signal indicative of the number of waveforms detected by the voltage detecting means 11 and also to compare the count with a predetermined value to thereby determine the amount of cloths to be washed that are put into the washtub 1.

The manner in which the amount of the cloths to be washed is determined by the determining means 12 will now be described in detail.

Figure 3:
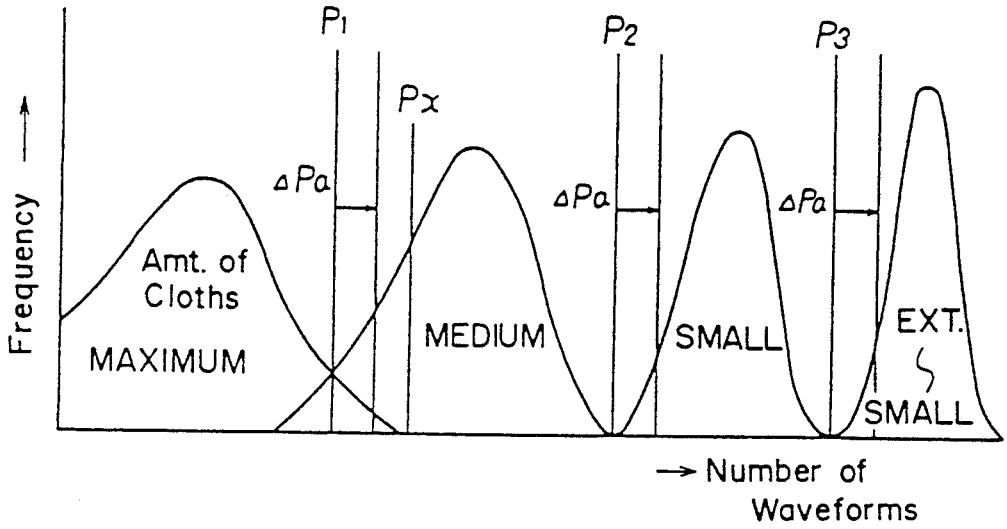
FIG. 3 is a graph showing a relationship between waveforms outputted from a voltage detecting means and the amount of cloths to be washed.

Referring to the graph of FIG. 3 showing a relationship between the amount of cloths put into the washtub 1 for washing and waveforms generated by the voltage detecting means 11, threshold values $P_1$, $P_2$ and $P_3$ are utilized as respective reference values. In the illustrated instance, the use of these three reference values represents four amount zones each indicative of a range of amount of cloths put into the washtub 1, namely, a "MAXIMUM" amount , a "MEDIUM" amount, a "SMALL" amount and an "EXTREMELY SMALL" amount. These reference values could be determined empirically by a correlation between the amount of cloths to be washed and the number of the output waveforms of the voltage detecting means 11. However, when the user of the washing machine feels that the amount of cloths determined by the determining means 12 is obviously improper or objectionable, for example, when the user of the washing machine feels that the water level detected by the water level detecting means 10 is obviously low for that amount of cloths under the situation in which the determining means 12 has determined that the amount of the cloths put into the washtub 1 was "MEDIUM" and, hence, the water level to which water should have been supplied into the hold 2 was determined a "medium" level for that medium amount of the cloths, the user of the washing machine can change the preset water level to a "high" level by manipulating the water level setting means 9*a*. The process control means 8 then performs the sequence of controls using the preset "high" water level and, at the same time, the determining means 12 changes one of the reference values to another one of the reference values in dependence on the number of the output waveforms, then generated by the voltage detecting means 11, and the amount of the cloths appropriate to the water level changed by the user of the washing machine.

One embodiment of how the reference value is changed will now be discussed in detail. Assuming that the output waveform generated by the voltage detecting means 11 at the time the amount of cloths in the washtub 1 is to be determined is such a value as indicated by Px in FIG. 3, the determining means 12 determines that the amount of the cloths put into the washtub 1 falls within the "MEDIUM" amount and the process control means 8 sets the water level within the hold 1 to a medium level. When under this situation the user of the washing machine manipulates the water level setting means 9*a* to set the water level to a high level by the reason that he or she had considered that the medium level of water is insufficient for the actual amount of the cloths, the determining means 12 responding to the change in water level setting adds a predetermined number of waveforms ΔPa to each of the reference values $P_1$, $P_2$ and $P_3$ to thereby shift the respective reference value to a higher value as shown by the following equations.

$$P_{1(M+1)}=P_{1(M)}+\Delta Pa$$

$$P_{2(M+1)}=P_{2(M)}+\Delta Pa$$

$$P_{3(M+1)}=P_{3(M)}+\Delta Pa$$

These shifted reference values are utilized subsequently for the determination of the amount of cloths put into the washtub 1. Thus, consequent on the change of the reference values, the amount of cloths determined by the determining means 12 increases.

On the other hand, in the case of the situation substantially reverse to that discussed above, that is, when the user of the washing machine manipulates the water level setting means 9a to set the water level within the hold 1 to a medium level under the situation in which the determining means 12 has determined that the amount of cloths put into the washtub 1 was "MAXIMUM" and, hence, the process control means 8 has set the water level within the hold 1 to a "high" level, the determining means 12 responds to the change in water level setting in such a way as to subtract a predetermined number of waveforms ΔPa from each of the reference values $P_1$, $P_2$ and $P_3$ to thereby shift the respective reference value to a lower value as shown by the following equations.

$$P_{1(M+1)}=P_{1(M)}-\Delta Pa$$

$$P_{2(M+1)}=P_{2(M)}-\Delta Pa$$

$$P_{3(M+1)}=P_{3(M)}-\Delta Pa$$

Thus, the change of the reference values used for the determination of the amount of cloths put into the washtub permits a cloth amount determining level of the determining means 12 to follow the setting made by the user of the washing machine. It is to be noted that the amount of change of each reference value is restricted to the amount not exceeding a predetermined value from the initial value thereof.

Figure 4:
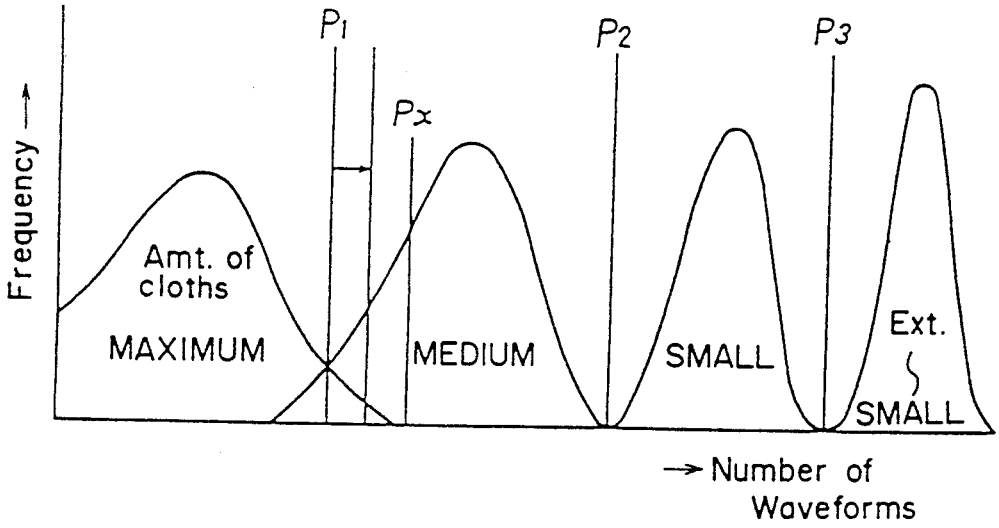
FIG. 4 is a graph showing a different relationship between the waveforms outputted from the voltage detecting means and the amount of cloths to be washed.

Another embodiment of how the reference value is changed will now be discussed in detail. Assuming that the output waveform generated by the voltage detecting means 11 at the time the amount of cloths in the washtub 1 is to be determined is such a value as indicated by Px in FIG. 4 as is the case with the foregoing example, the determining means 12 determines that the amount of the cloths put into the washtub 1 falls within the "MEDIUM" amount and the process control means 8 sets the water level within the hold 1 to a medium level. When under this situation the user of the washing machine manipulates the water level setting means 9a to set the water level to a high level by the reason that he or she had considered that the medium level of water is insufficient for the actual amount of the cloths, the water level falling within an allowance for the "MEDIUM" level in which the number of the waveforms Px is included is changed by the reference value $P_1$, which corresponds to the selected high water level, in proportion to the difference between the number Px of the waveforms then inputted and the reference value $P_1$ as shown by the following equation, thereby allowing the reference value to be increased.

$$P_{1(M+1)}=P_{1(M)}+\{Px-P_{1(M)}\}/2$$

This shifted reference value is utilized subsequently for the determination of the amount of cloths put into the washtub 1. Thus, consequent on the change of the reference value, the range within which the amount of cloths to be washed are determined great expands and, therefore, the amount of the cloths to be washed comes to have a tendency of being determined great as compared with that rendered during the previous determination.

Where consequent on the change of the reference value the range (for example, the region between $P_1$ and $P_2$) within which the amount of cloths to be washed is determined is narrowed, the width of this range is restricted to a value greater than a predetermined value Pw and no change of the reference value occur exceeding this limit. Thus, since consequent on this change of the reference value the cloth amount determining level of the determining means 12 sequentially updated individually for each rank of the amount of cloths according to the determination made by the user of the washing machine, the reference value used for the determination of the amount of cloths varies with the actual amount of cloths put into the washtub 1 and, therefore, there is no possibility that the user may effect a correction each time the reference value departs.

Although the present invention has fully been described in connection with the various embodiments thereof with reference to the accompanying drawings, it is to be noted that various changes and modifications are apparent to those skilled in the art. For example, although in the foregoing description of the preferred embodiment of the present invention reference has been made to the use of the determining means of a type wherein, while the use has been made of the voltage detecting means for detecting the motor voltage, the drive motor is driven after the water has been supplied into the hold and then the amount of cloths is determined, any motor speed detecting means such as one or more magnets may be employed in place of the voltage detecting means. A system wherein the amount of cloths is detected by driving the motor before the water is supplied into the hold, or a system wherein a detection is made of a change in level of the water within the hold during agitation, can also be employed in place of the foregoing system, provided that the physical quantity correlated with the amount of cloths put into the washtub can be detected.

Such changes and modifications are to be understood as included within the scope of the present invention as defined by the appended claims, unless they depart therefrom.

What is claimed is:

1. A cloth amount detecting device in a washing machine which comprises:

a detecting means for outputting a cloth signal representative of the amount of cloths put into the washing machine;

a determining means operable to receive the cloth signal and for comparing the received cloth signal with a reference value to thereby determine the amount of the cloths; and a selector means operable by a user of the washing machine for changing the reference value to a different reference value;

wherein said determining means stores the reference value which has been selected by the selector means and, during the next succeeding determination of the amount of cloths, determines the amount of cloths using the selected reference value which has been selected.

2. The device as claimed in claim 1, wherein said selector means determines the amount of change by which the reference value is to be changed, in dependence on a difference between the reference value, currently used, and a detected cloth amount data represented by the cloth signal outputted from the detecting means.

3. The device as claimed in claim 2, wherein said determining means has a plurality of reference values in correspondence with respective different amounts of cloths which may be put into the washing machine, said determining means being operable to compare the cloth signal with one of the reference values to determine the amount of the cloths then put into the washing machine, thereby allowing water to be supplied to one of washing and rinsing water levels, and wherein said selector means includes an input unit of inputting whether the level of water determined and supplied by the determining means is too high for a water level desired by the user or whether the level of water determined and supplied by the determining means is too low for the water level desired by the user, a predetermined value being added to the currently employed reference value in the event that there is an input from the input unit indicating that the water level is sufficiently high than the water level desired by the user, but subtracted from the currently employed reference value in the event that there is an input from the input unit indicating that the water level is lower than the water level desired by the user.

4. The device as claimed in claim 1, wherein said selector means employs a predetermined value from the reference value, which is currently employed, as an amount of change by which said reference value is to be changed and determines whether said predetermined value should be added to or subtracted from the reference value currently employed.

5. The device as claimed in claim 4, wherein said determining means has a plurality of reference values in correspondence with respective different amounts of cloths which may be put into the washing machine, said determining means being operable to compare the cloth signal with one of the reference values to determine the amount of the cloths then put into the washing machine, thereby allowing water to be supplied to one of washing and rinsing water levels, and wherein said selector means includes an input unit of inputting whether the level of water determined and supplied by the determining means is too high for a water level desired by the user or whether the level of water determined and supplied by the determining means is too low for the water level desired by the user, said predetermined value being added to the currently employed reference value in the event that there is an input from the input unit indicating that the water level is sufficiently high than the water level desired by the user, but subtracted from the currently employed reference value in the event that there is an input from the input unit indicating that the water level is lower than the water level desired by the user.

6. A cloth amount detecting device in a washing machine which comprises:

a detecting means for outputting a cloth signal representative of the amount of cloths put into the washing machine;

a determining means operable to receive the cloth signal and for comparing the received cloth signal with a reference value to thereby determine the amount of the cloths; and a selector means operable by a user of the washing machine for changing the reference value to a different reference value;

wherein said selector means determines the amount of change by which the reference value is to be changed, in dependence on a difference between the reference value, currently used, and a detected cloth amount data represented by the cloth signal outputted from the detecting means.

7. The device as claimed in claim 6, wherein said determining means has a plurality of reference values in correspondence with respective different amounts of cloths which may be put into the washing machine, said determining means being operable to compare the cloth signal with one of the reference values to determine the amount of the cloths then put into the washing machine, thereby allowing water to be supplied to one of washing and rinsing water levels, and wherein said selector means includes an input unit of inputting whether the level of water determined and supplied by the determining means is too high for a water level desired by the user or whether the level of water determined and supplied by the determining means is too low for the water level desired by the user, a predetermined value being added to the currently employed reference value in the event that there is an input from the input unit indicating that the water level is sufficiently high than the water level desired by the user, but subtracted from the currently employed reference value in the event that there is an input from the input unit indicating that the water level is lower than the water level desired by the user.

8. A cloth amount detecting device in a washing machine which comprises:

a detecting means for outputting a cloth signal representative of the amount of cloths put into the washing machine;

a determining means operable to receive the cloth signal and for comparing the received cloth signal with a reference value to thereby determine the amount of the cloths; and a selector means operable by a user of the washing machine for changing the reference value to a different reference value;

wherein said selector means employs a predetermined value from the reference value, which is currently employed, as an amount of change by which said reference value is to be changed and determines whether said predetermined value should be added to or subtracted from the reference value currently employed.

9. The device as claimed in claim 8, wherein said determining means has a plurality of reference values in correspondence with respective different amounts of cloths which may be put into the washing machine, said determining means being operable to compare the cloth signal with one of the reference values to determine the amount of the cloths then put into the washing machine, thereby allowing water to be supplied to one of washing and rinsing water levels, and wherein said selector means includes an input unit of inputting whether the level of water determined and supplied by the determining means is too high for a water level desired by the user or whether the level of water determined and supplied by the determining means is too low for the water level desired by the user, said predetermined value being added to the currently employed reference value in the event that there is an input from the input unit indicating that the water level is sufficiently high than the water level desired by the user, but subtracted from the currently employed reference value in the event that there is an input from the input unit indicating that the water level is lower than the water level desired by the user.

* * * * *